US007300258B2

(12) United States Patent
Peysakhovich et al.

(10) Patent No.: US 7,300,258 B2
(45) Date of Patent: Nov. 27, 2007

(54) ELECTROMAGNETIC PUMP

(75) Inventors: Vitaly A. Peysakhovich, Moorestown, NJ (US); Oleg S. Fishman, Maple Glen, PA (US); Emad Tabatabaei, Voorhees, NJ (US)

(73) Assignee: Inductotherm Corp., Rancocas, NJ (US)

( * ) Notice: Subject to any disclaimer, the term of this patent is extended or adjusted under 35 U.S.C. 154(b) by 719 days.

(21) Appl. No.: 10/825,634

(22) Filed: Apr. 15, 2004

(65) Prior Publication Data

US 2004/0219026 A1 Nov. 4, 2004

Related U.S. Application Data

(60) Provisional application No. 60/464,317, filed on Apr. 21, 2003.

(51) Int. Cl.
*H02K 44/06* (2006.01)

(52) U.S. Cl. ..... 417/50; 417/53

(58) Field of Classification Search ..... 417/50, 417/53

See application file for complete search history.

(56) References Cited

U.S. PATENT DOCUMENTS

| | | | | |
|---|---|---|---|---|
| 4,166,714 | A * | 9/1979 | Rienass et al. | 417/50 |
| 4,557,667 | A * | 12/1985 | Delassus et al. | 417/50 |
| 4,776,767 | A * | 10/1988 | Motomura | 417/50 |
| 4,928,933 | A * | 5/1990 | Motomura | 417/50 |
| 5,642,011 | A * | 6/1997 | Fanning et al. | 310/11 |

* cited by examiner

*Primary Examiner*—Michael Koczo, Jr.
(74) *Attorney, Agent, or Firm*—Philip O. Post

(57) ABSTRACT

An electromagnetic pump has a supply section and a magnetic force pumping section wherein flow of a electrically conductive material through the supply section is opposite to the flow of the material in the magnetic force pumping section in some examples. Multiple coils surround the supply and magnetic force pumping sections. Current flowing through the multiple coils creates magnetic fields that magnetically couple with a magnetic material disposed between the supply and magnetic force pumping sections so that the fields penetrate the electrically conductive material in the magnetic force pumping section substantially perpendicular to the desired flow direction which maximizes the magnitudes of magnetic forces applied to the electrically conductive material.

8 Claims, 6 Drawing Sheets

ELECTROMAGNETIC PUMP

CROSS REFERENCE TO RELATED APPLICATIONS

This application claims the benefit of U.S. Provisional Application No. 60/464,317 filed Apr. 21, 2003, hereby incorporated herein by reference.

FIELD OF THE INVENTION

The present invention relates to electromagnetic pumps that move an electrically conductive fluid by interaction with magnetic fields.

BACKGROUND OF THE INVENTION

Electromagnetic pumps can be used to pump electrically conductive fluids, such as an electrically conductive molten metal composition. An advantage of an electromagnetic pump is that the fluid can be magnetically induced to move through a tube or conduit without the use of mechanical pump components inside of the conduit.

Known electromagnetic pumps are either submersed in, or integrally attached to, the source of the electrically conductive fluid, such as a metal melting and/or melt holding furnace. These pump installations are difficult to service and maintain. Therefore there is the need for an efficient and easily maintainable electromagnetic pump that is not integrally attached to the source of the electrically conductive fluid.

BRIEF SUMMARY OF THE INVENTION

In one aspect, the invention is apparatus for and method of pumping an electrically conductive material in a pump having a supply section or volume, and a magnetic force pumping section or volume. In one example of the invention the directional flow of the material through the supply section is opposite to the directional flow of the material through the magnetic force pumping section. Multiple coils surround the supply and magnetic force pumping sections. Current flowing through the multiple coils creates magnetic fields that magnetically couple with a magnetic material disposed between the supply and magnetic force pumping sections so that the fields penetrate the electrically conductive material in the magnetic force pumping section substantially perpendicular to the desired flow direction. This field orientation maximizes the magnitudes of the magnetic forces applied to the electrically conductive material in the magnetic force pumping section.

These and other aspects of the invention are set forth in the specification.

BRIEF DESCRIPTION OF THE DRAWINGS

The figures, in conjunction with the specification and claims, illustrate one or more non-limiting modes of practicing the invention. The invention is not limited to the illustrated layout and content of the drawings.

FIG. 3(*b*) is a top sectional view through line B-B in FIG. 2 of one example of an electromagnetic pump of the present invention.

FIG. 3(*c*) is a partial sectional view of the interface region for inner, mid and outer tubes, and magnetic material, used in one example of an electromagnetic pump of the present invention.

FIG. 4(*b*) is a vector diagram illustrating one example of phase distribution of the output of a power supply to the induction coils used with an electromagnetic pump of the present invention.

DETAILED DESCRIPTION OF THE INVENTION

Figure 1:
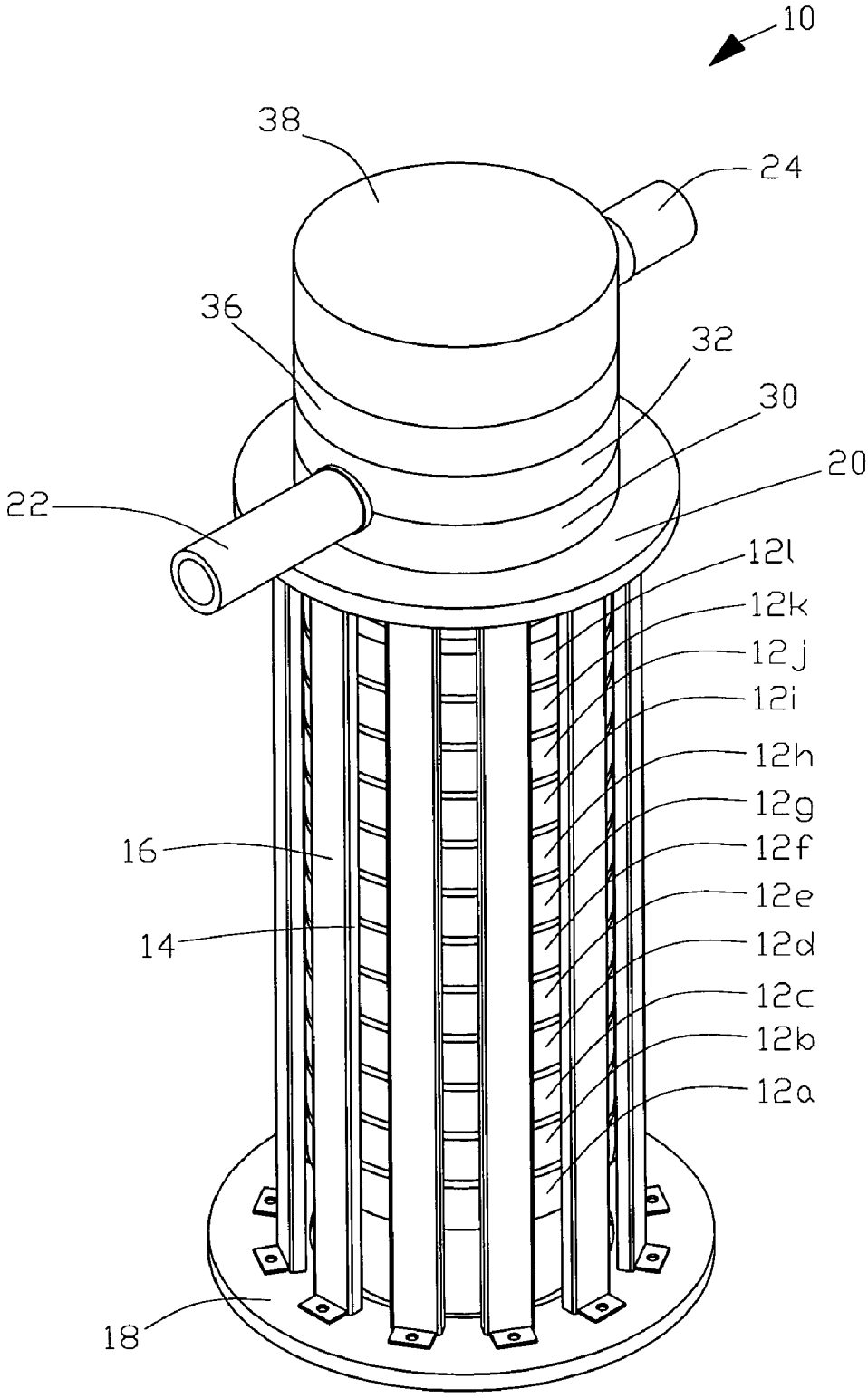
FIG. 1 is a side perspective view of one example of an electromagnetic pump of the present invention.

Referring now to the drawings, wherein like numerals indicate like elements, there is shown in the figures one example of electromagnetic pump 10 of the present invention for pumping an electrically conductive material, such as an electrically conductive molten metal. In FIG. 1, twelve induction coils (12*a* through 12*l*) as further described below, are surrounded by a plurality of vertical magnetic shunts 14 held in place by shunt supports 16, which are attached to base 18 at one end, and to yoke 20 at the opposing end. The base and yoke may optionally be formed from a magnetic material to provide bottom and top magnetic field containment. Other shunt and outer support arrangements as known in the art may be used in lieu of the shunt and support arrangements shown in FIG. 1. Pump inlet 24 and pump outlet 22 in this non-limiting example of the invention, are cylindrically formed from a suitable heat-resistant material.

Figure 2:
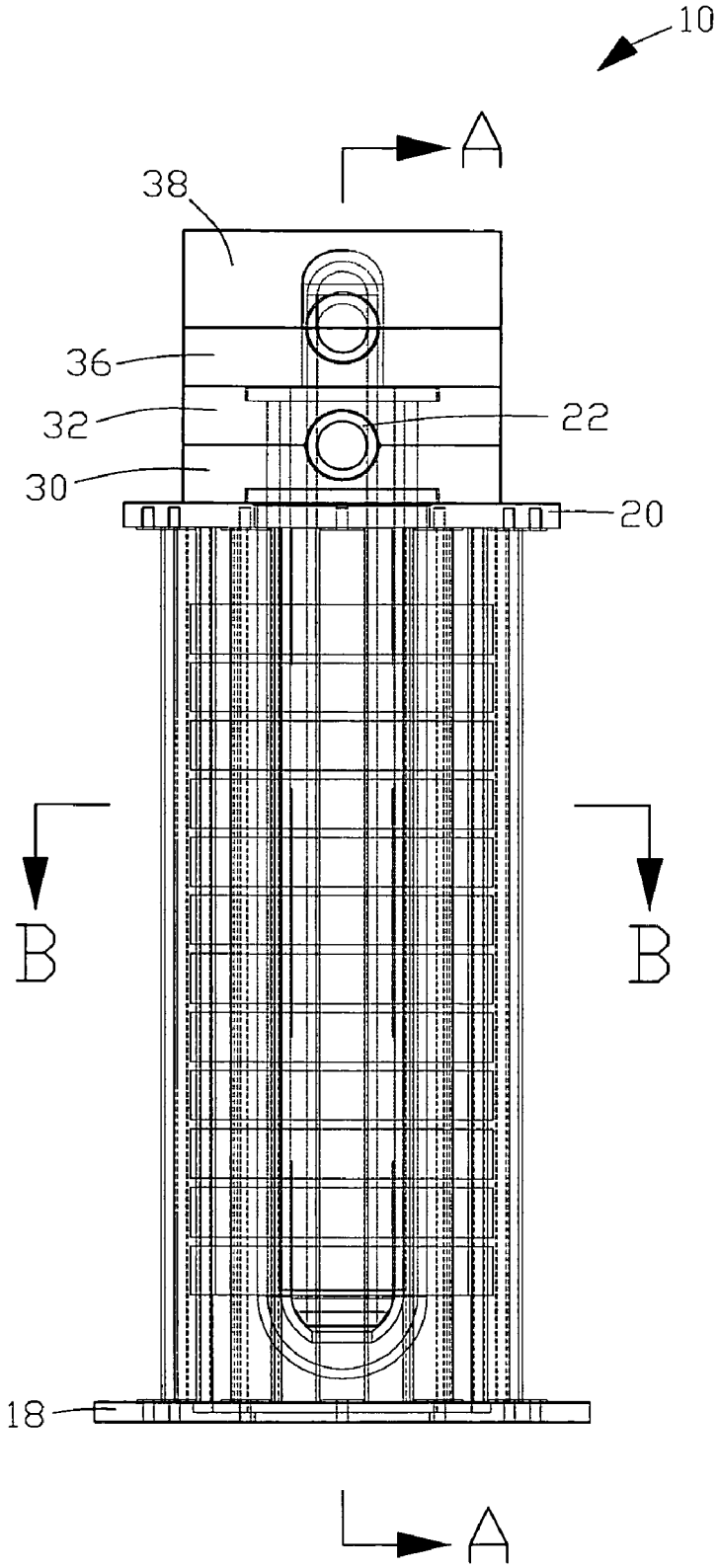
FIG. 2 is a side elevational view of one example of an electromagnetic pump of the present invention.
Figure 3A:
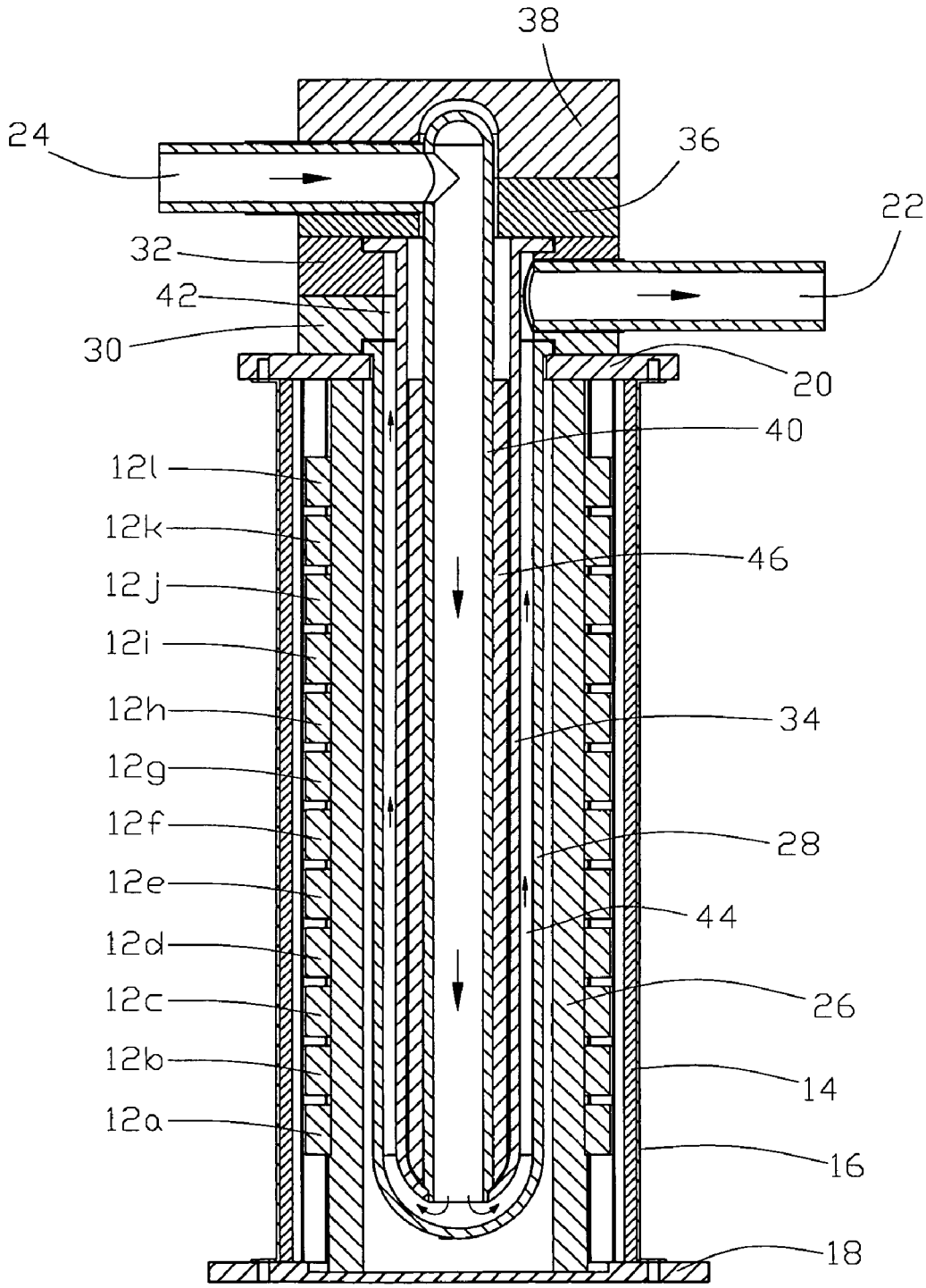
FIG. 3(*a*) is a side sectional view through line A-A in FIG. 2 of one example of an electromagnetic pump of the present invention.
Figure 3B:
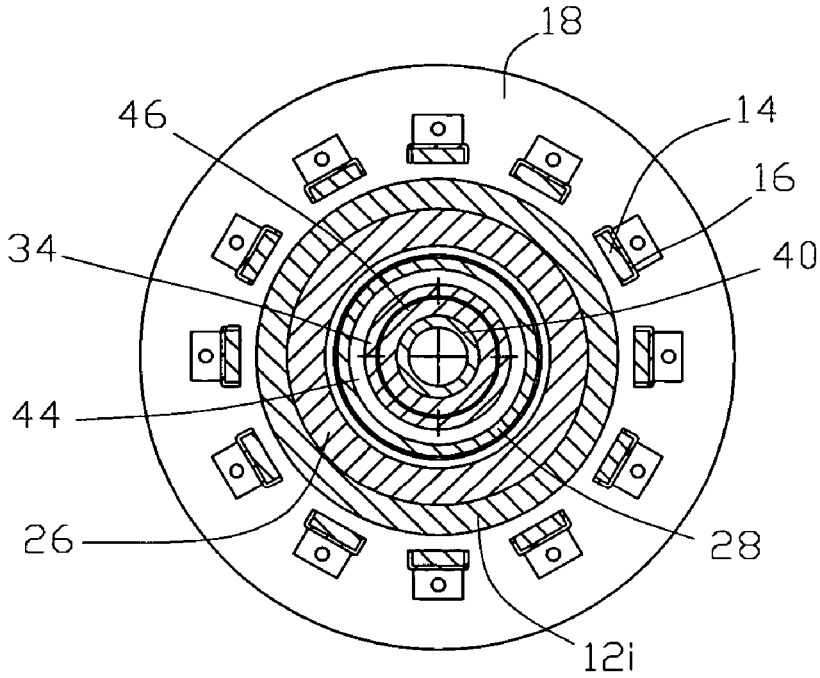
Figure 3C:
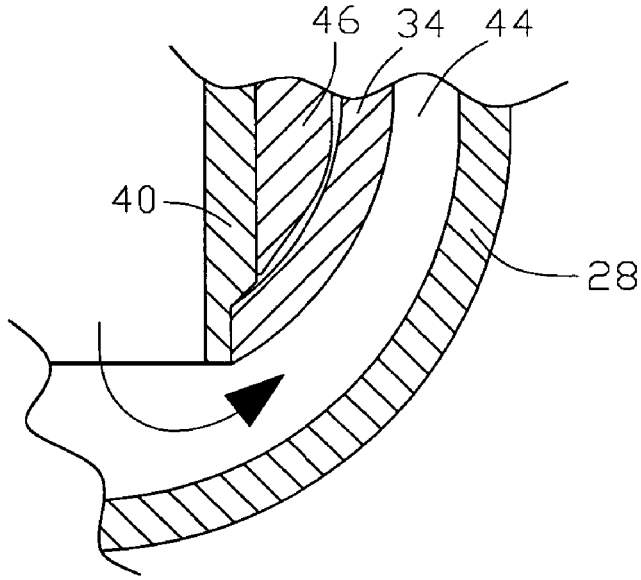

Referring now to FIG. 3(*a*), which is a side sectional of electromagnetic pump 10 shown in FIG. 2, optional thermal insulator 26 separates the induction coils from the interior of the pump and provides a means for molten metal (melt) heat retention for melt in the pump. In this non-limiting example of the invention, the thermal insulator is substantially shaped as an open cylinder bounded by base 18 and yoke 20. Outer tube 28 in this non-limiting example of the invention, is a substantially cylindrically-shaped tube that has a closed rounded bottom and an opened top with a protruding lip around the opening. The outer tube's lip sits on top of yoke 20.

First closing means 30 seats over yoke 20 and the protruding lip of the outer tube. Second closing means 32 seats over first closing means 30. Outlet 22 is disposed between the first and second closing means. Mid tube 34 in this non-limiting example of the invention is a substantially cylindrically-shaped tube that is opened at both ends with the upper end having a protruding lip around the opening. The mid tube's lip is seated in a recess in second closing means 32. The first and second closing means are arranged to form an outlet annular volume 42 that connects the interior passage of outlet 22 to riser annular volume 44 that is disposed between the outer wall of mid tube 34 and the inner wall of outer tube 28. Third closing means 36 seats over second closing means 32. Inner tube 40 in this non-limiting example of the invention is a substantially cylindrically-spaced tube that has an open bottom and a closed top. As best seen in FIG. 3(*c*) the perimeter of the inner tube's open bottom forms a fluid tight seal with the perimeter of the mid tube's open bottom. Magnetic material 46 is disposed in a volume between the outer wall of inner tube 40 and the inner wall of mid tube 34 as further described below. Fourth closing means 38 seats over third closing means 36 and the closed top of inner tube 40. Inlet 24 is disposed between the third and fourth closing means and its interior passage is connected to the interior passage of inner tube 40. FIG. 3(*b*) is a sectional view that illustrates the spatial relationship of components in a horizontal plane.

The above non-limiting examples of the invention provide a convenient means for assembly or disassembly of pump 10. Removal of fourth closing means 38 allows inlet 24 and inner tube 40 to be raised out of the pump. Further removal of third closing means 36 allows magnetic material 46 and mid tube 34 to be raised out of the pump. Further removal of second closing means 32 allows removal of outlet 22. Further removal of first closing means 30 allows removal of outer tube 28.

The above examples of the invention provide a convenient means for changing the angular orientation between inlet 24 with outlet 22. In a particular installation, supply and outlet conduit (not shown in the drawings) that are to be connected to inlet 24 and outlet 22 respectively, may not be oriented to accept the 180 degrees angular orientation (looking down on the top of the pump) between the inlet and outlet for pump 10 as shown in FIG. 1. First closing means 30 and second closing means 32 may be rotated and secured into a position different from that shown in FIG. 1 to change the angular orientation of inlet 24 to outlet 22, which outlet is contained by the first and second closing means. Third closing means 36 and fourth closing means 38 may be rotated and secured into a position different from that shown in FIG. 1 to change the angular orientation of outlet 22 to inlet 24, which inlet is contained by the third and fourth closing means.

Molten metal flows through pump 10 in the direction indicated by the arrows in FIG. 3(*a*). The melt enters the pump through inlet 24 and flows down the interior cylindrical passage of inner tube 40. This section of the pump is referred to as the supply section. The melt then moves by magnetic forces, as further described below, up riser annular volume 44 (the magnetic force pumping section), into outlet annular volume 42, and finally out of the pump through outlet 22. In other examples of the invention, outlet 22 may connect directly to riser annular volume 44 rather than being intermediately connected to it by outlet annular volume 42 formed between the inner wall of mid tube 34 and the inner annular walls of the first and second annular closing means. The outer tube, mid tube and inner tube are formed from a suitable heat resistant material such as a ceramic composition. One non-limiting type of ceramic composition that may used to cast the outer, mid and inner tubes, as well as inlet 24 and outlet 22 is a silicon-aluminum-oxynitride composition known as sialon.

Figure 4B:
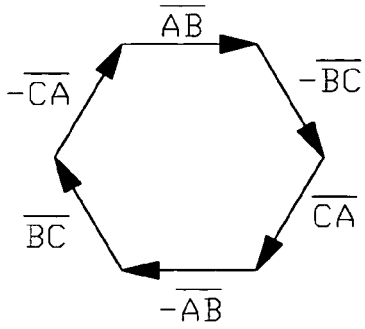
FIG. 4(*a*) is a simplified schematic diagram of a power supply and power distribution to induction coils used with an electromagnetic pump of the present invention.
Figure 4A:
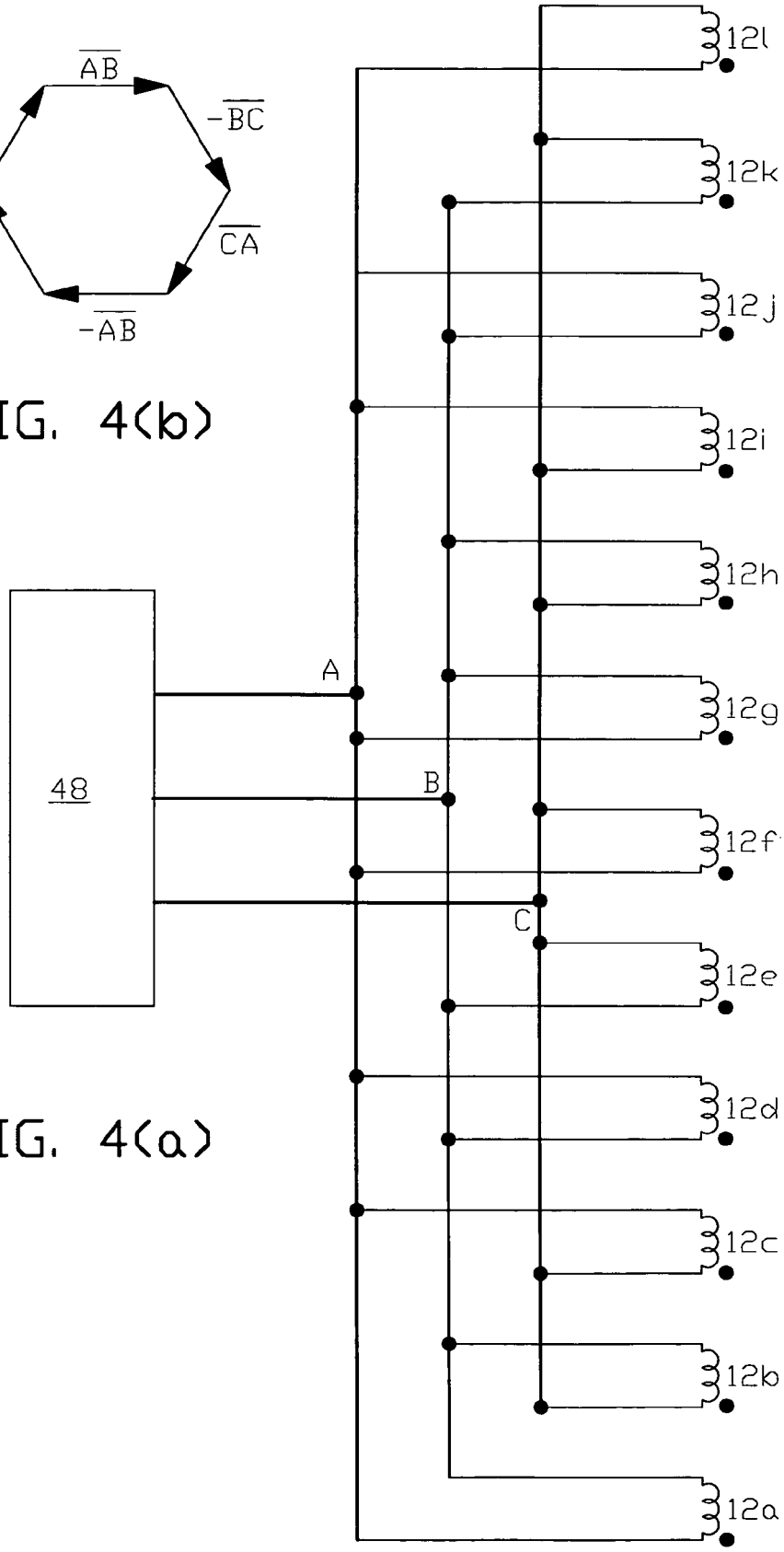

As disclosed above an applied magnetic force causes the electrically conductive melt to flow through pump 10. There is shown in FIG. 4(*a*) one diagrammatic example of supplying power to the induction coils to cause the molten metal to flow through pump 10 by magnetic force. Power supply 48 is a three-phase output power supply with variable output frequency and output voltage. One suitable type of supply is a solid state supply with a pulse width modulated output. FIG. 4(*b*) is a vector diagram illustrating a six-cycle connection scheme from the power supply to the coils that is used to produced magnetic forces that act on the molten metal in riser annular volume 44 to force the melt up the riser annual volume and through outlet 22, and thus pulling molten metal through pump 10 from a suitable source of molten metal that can be connected to inlet 24. As illustrated in the diagram and vector diagram, the six-cycle scheme is created by sequentially connecting each of the three phases with alternating positive and negative phase orientation. That is phase +AB is followed by phase −BC, which is followed by phase +CA, which is followed by phase −AB, which is followed by phase +BC, which is followed by phase −CA. The six-cycle connection scheme for induction coils 12*a* through 12*f* repeats for induction coils 12*g* through 12*l*. The choice of a six-cycle connection scheme is not limiting, but a six-cycle scheme (with 30 electrical degrees phase angle between voltages in adjacent coils) provides a more uniform flow rate than, for example, a three-cycle scheme (with 60 electrical degrees phase angle between voltages in adjacent coils). Since the magnitude of the output voltage of power supply 48 is directly proportional to the magnitude of the magnetic force applied to the molten metal, varying the output voltage of the power supply will vary the magnetic lifting force and flow rate of a molten metal through the pump.

The magnetic forces generated in riser annular volume 44 are substantially vertical in the upwards direction since the magnetic field generated around each of the coils substantially forms a magnetic circuit with magnetic material 46 and the field path through the molten metal in the riser annular volume is substantially horizontally-oriented. If a hot molten metal is pumped by electromagnetic pump 10, magnetic material 46 must have a Curie temperature (point at which the magnetic material loses its magnetic properties) greater than the temperature of the molten metal flowing through the pump. For these applications a high Curie temperature magnetic material must be used. For example, molten aluminum typically may flow through the pump at a temperature of ranging from 680° C. to 800° C. For this application the magnetic material must have a Curie temperature of at least 850° C. which is the maximum temperature of the aluminum melt plus design margin. One suitable type of high Curie temperature magnetic material 46 for this application is a class of iron-cobalt alloys known as permendur.

It is preferable, but not required, that each induction coil be formed as a thin-wire, multiple-turn (typically 500 or more turns) coil commonly referred to as a bobbin magnetic coil since it is formed by winding thin wire around a bobbin that is removed after winding. Since the magnitude of magnetic force created by a magnetic field is directly proportional to both current flow through the coil and the number of turns in the coil, using a coil with a large number of turns keeps the required output current from power supply 48 at a low level for a given magnitude of magnetic force.

If the source of molten metal to the pump is located below the horizontal level of inlet 24, pump 10 will need to be initially primed by filing the interior passage of inner tube 40 with melt. One method of accomplishing this is by attaching a vacuum pump to outlet 22 and drawing a vacuum on the melt flow passages within pump 10 to suction melt from a supply of molten metal connected to inlet 24. In other examples of the invention, the top of inner tube 40 may be open and penetrate through fourth closing means 38 in, for example, a funnel-shaped opening into which molten metal can be poured to prime the pump by filling the inner tube.

When pump 10 is not in use, stationary molten metal in the pump may cool and "freeze" within the pump's internal flow passages. To prevent this from happening, a cyclical emptying and filling of riser annular volume 44 with molten metal may be electromagnetically accomplished. Reversing the direction of all phase vectors in FIG. 4(*b*) will create a magnetic force on molten metal in riser annular volume 44 that will force it down and push molten metal back though inlet 24 to the source of molten metal connected to the inlet. Subsequently reversing all phase vectors back to the directions shown in FIG. 4(*b*) will create a magnetic force that will cause molten metal to rise up in the riser annular volume. This jogging motion of molten metal will prevent freezing of molten metal in the pump when it is not in use. In other examples of the invention, if a three phase power supply is used, cyclically reversing two of the phases with, for example, solid state switches, can also be used to accomplish the electromagnetic jogging motion of melt in the pump. In other examples of the invention, a heating medium, such as a circulating hot gas or liquid, or an electric heating element, may be provided in the volume between thermal insulator 26 and the outer wall of outer tube 28.

Figure 5:
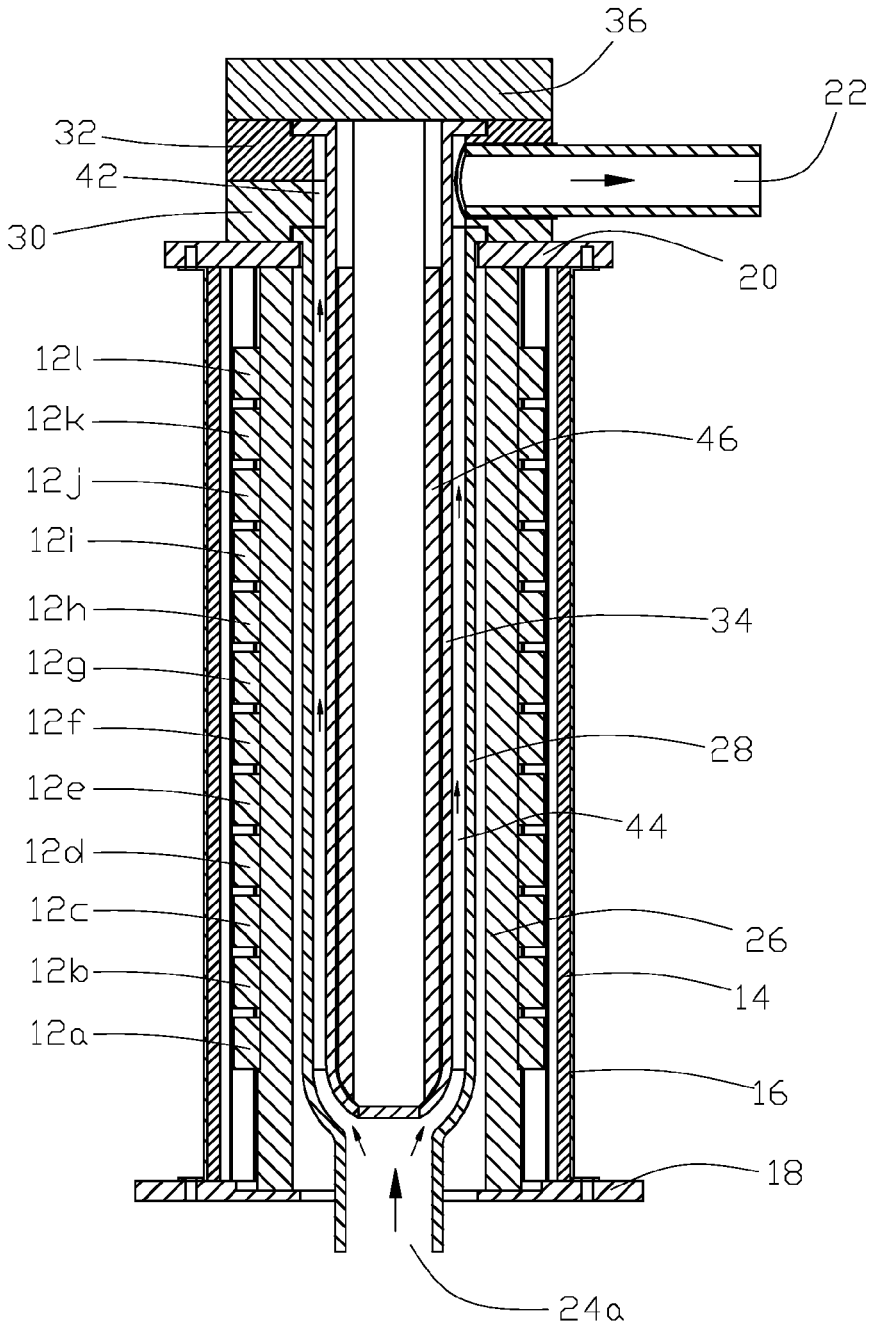
FIG. 5 is a side sectional view of another example of an electromagnetic pump of the present invention.

FIG. 5 illustrates another example of an electromagnetic pump of the present example. In this example, inlet 24*a* is at the bottom of the pump and molten metal is electromagnetically pumped directly up riser annular volume 44 as generally described in previous examples of the invention. In this particular example since molten metal does not flow through the inner tube, the inner tube may be a totally enclosed tube or other inner structural element that serves as a means for containing magnetic material 46 between the inner structural element and mid tube 34.

Other types of power supply and distribution arrangements are contemplated within the scope of the invention. For example, multiple single phase power supplies may be used; each coil may be powered by an individual power supply; or separate power supplies may power individual groups of coils. Further although in the above examples of the invention the inner, mid and outer tubes have their longitudinal axes vertically oriented, the longitudinal axes of the tubes may be otherwise oriented without deviating from the scope of the invention.

The examples of the invention include reference to specific electrical components. One skilled in the art may practice the invention by substituting components that are not necessarily of the same type but will create the desired conditions or accomplish the desired results of the invention. For example, single components may be substituted for multiple components or vice versa.

The foregoing examples do not limit the scope of the disclosed invention. The scope of the disclosed invention is further set forth in the appended claims.

The invention claimed is:

1. An apparatus for pumping an electrically conductive material, the apparatus comprising:

an open outer tube having a closed bottom;

an open mid tube disposed within the outer tube to form an annular volume between the inner wall of the outer tube and outer wall of the mid tube, the top of the annular volume in communication with an outlet for exit of the electrically conductive material from the apparatus;

an open inner tube disposed within the mid tube;

a magnetic material disposed between the outer wall of the inner tube and the inner wall of the mid tube;

an inlet for entry of the electrically conductive material into the open inner tube, the inlet disposed near the top of the open inner tube and in communication with the opening in the inner tube;

a plurality of induction coils disposed around the exterior height of the outer tube; and a means for supplying an ac current to each of the plurality of induction coils to force the electrically conductive material up through the annular volume and the outlet by the magnetic forces applied to the electrically conductive material by the magnetic fields created by the supply of the ac current to each of the plurality of induction coils.

2. The apparatus of claim 1 wherein the means for supplying the ac current to each of the plurality of induction coils comprises a power supply having a three phase output wherein each two of the three phases, with alternating positive and negative phase orientation, are sequentially connected to the plurality of induction coils to create a six phase cycle of the magnetic fields to force the electrically conductive material up through the annular volume and the outlet.

3. The apparatus of claim 2 wherein the power supply has a variable output voltage or output frequency.

4. The apparatus of claim 1 wherein each of the plurality of induction coils comprises a bobbin magnetic coil.

5. A method of pumping an electrically conductive material comprising the steps of:

providing a supply of the electrically conductive material into an opening of an open inner tube;

inserting an open mid tube around the exterior of the inner tube;

inserting an open outer tube with closed bottom around the exterior of the mid tube to form an annular volume between the mid tube and the outer tube, the annular volume in communication with the electrically conductive material in the open inner tube;

disposing a magnetic material between the outer wall of the inner tube and the inner wall of the mid tube;

surrounding the exterior of the outer tube with a plurality of induction coils; and applying an ac current to each of the plurality of induction coils to force the electrically conductive material up through the annular volume and the outlet by the magnetic forces applied to the electrically conductive material by the magnetic fields created by the ac current in each of the plurality of induction coils.

6. The method of claim 5 further comprising the step of supplying the ac currents to each of the plurality of induction coils from a three phase supply wherein each two of the three phases, with alternating positive and negative phase orientation, are sequentially connected to the plurality of induction coils.

7. A method of pumping an electrically conductive material comprising the steps of:

providing a supply of the electrically conductive material into a supply volume formed in an open inner tube;

inserting an open mid tube around the exterior of the inner tube;

inserting an open outer tube with closed bottom around the exterior of the mid tube to form a magnetic force pumping volume between the mid tube and the outer tube, the magnetic force pumping volume in communication with the supply volume;

disposing a magnetic material between the inner tube and the mid tube;

surrounding the exterior of the outer tube with a plurality of induction coils; and applying ac current to each of the plurality of induction coils to move the electrically conductive material through the magnetic force pumping volume by magnetic forces applied to the electrically conductive material by the magnetic fields created by the ac current in each of the plurality of induction coils, thereby moving the supply of electrically conductive material through the supply volume and into the magnetic force pumping volume with the directional flow of the electrically conductive material in the supply volume generally opposite to the directional flow of the electrically conductive material in the magnetic force pumping volume.

8. The method of claim 7 further comprising the step of supplying the ac currents to each of the plurality of induction coils from a three phase supply wherein each two of the three phases, with alternating positive and negative phase orientation, are sequentially connected to the plurality of induction coils.

* * * * *